US005714298A

United States Patent [19]

Barthelemy et al.

[11] Patent Number: 5,714,298

[45] Date of Patent: Feb. 3, 1998

[54] METHOD FOR FIXING A TONER IN A COPIER AND COMPOSITIONS USED IN THIS METHOD

[75] Inventors: Pierre Barthelemy, Pietrebais; Robert Putteman, Lebbeke, both of Belgium

[73] Assignee: Solvay (Societe Anonyme), Brussels, Belgium

[21] Appl. No.: 773,957

[22] Filed: Dec. 26, 1996

[30] Foreign Application Priority Data

Jan. 15, 1996 [BE] Belgium ..... 09600029

[51] Int. Cl.[6] ..... G03G 13/20

[52] U.S. Cl. ..... 430/124

[58] Field of Search ..... 430/124

[56] References Cited

U.S. PATENT DOCUMENTS

| | | | |
|---|---|---|---|
| 4,311,723 | 1/1982 | Mugrauer | 427/335 |
| 5,333,042 | 7/1994 | Brennan et al. | 430/124 |

FOREIGN PATENT DOCUMENTS

| | | |
|---|---|---|
| 0465037 | 1/1992 | European Pat. Off. . |
| 0605128 | 7/1994 | European Pat. Off. . |
| 3252500 | 11/1991 | Japan . |
| 5171185 | 7/1993 | Japan . |
| 5186793 | 7/1993 | Japan . |
| 5239767 | 9/1993 | Japan . |
| 6041591 | 2/1994 | Japan . |
| 6049490 | 2/1994 | Japan . |
| 6049491 | 2/1994 | Japan . |
| 6049492 | 2/1994 | Japan . |
| 6100891 | 4/1994 | Japan . |
| 6179897 | 6/1994 | Japan . |
| 6322395 | 11/1994 | Japan . |
| 93/10485 | 5/1993 | WIPO . |
| 95/06693 | 3/1995 | WIPO . |
| 96/10062 | 4/1996 | WIPO . |

OTHER PUBLICATIONS

Kirk–Othmer—Encyclopedia of Chemical Technology, 4th Ed., vol. 9, pp. 270–271.

*Primary Examiner*—Roland Martin
*Attorney, Agent, or Firm*—Spencer & Frank

[57] ABSTRACT

In order to fix a toner to a recording substrate in a document printer or copier, the recording substrate on which the toner is deposited is brought into contact with a chemical fixing agent in the gaseous state containing a $C_3$ –$C_6$ hydrofluorocarbon and, preferably, a cosolvent.

9 Claims, No Drawings

METHOD FOR FIXING A TONER IN A COPIER AND COMPOSITIONS USED IN THIS METHOD

The present invention relates to a method for fixing a toner in a document printer or copier and to compositions which can be used in this method.

It is known to use halogenated hydrocarbons, alone or mixed with other organic compounds, in the gaseous state, as chemical agents for fixing a toner to a recording substrate in document printers or copiers, the toner having been deposited beforehand in these devices on the recording substrate, for example electrostatically. It is obviously essential for the fixing agent used not to exhibit a flash point under the temperature and pressure conditions prevailing in the printers or copiers. A conventional fixing agent is composed of an azeotropic mixture of 1,1,2-trichlorotrifluoroethane (CFC-113) and acetone, as provided in U.S. Pat. No. 4,311,723. However, as CFC-113 is suspected of having a negative effect on the stratospheric ozone layer, international regulations will ultimately ban its use. Replacement fixing agents have already been provided, in particular 1,1-dichloro-2,2,2-trifluoroethane (HCFC-123) or 1,1-dichloro-1-fluoroethane (HCFC-141b) (WO-A-93/10485), compositions based on perfluorinated compounds (EP-A-0,465,037) and compositions based on HCFC-141b (EP-A-0,605,128). However, these compositions are not entirely satisfactory, in particular because of their toxicity (HCFC-123), because they retain their potential to destroy ozone (HCFC-123 and HCFC-141 b) and/or because of their excessively long lifetime in the atmosphere (perfluorinated compounds).

The aim of the present invention is to provide a method for fixing a toner in a document printer or copier which no longer exhibits the disadvantages of the known methods.

The invention consequently relates to a method for fixing a toner to a recording substrate in a document printer or copier by bringing the recording substrate, on which the toner is deposited, into contact with a chemical fixing agent in the gaseous state, which is characterized in that the fixing agent contains a $C_3$–$C_6$ hydrofluorocarbon.

$C_3$–$C_6$ hydrofluorocarbon is understood to denote aliphatic or alicyclic saturated hydrocarbons, consisting solely of carbon, fluorine and hydrogen, comprising from 3 to 6 carbon atoms, at least one fluorine atom and at least one hydrogen atom. In particular, hydrofluorocarbons which can be used as fixing agent in the method according to the invention are hydrofluoroalkanes of general formula $C_aH_bF_c$ in which a is an integer from 3 to 5, b is an integer from 1 to (a+2) and c is an integer from a to (2a+1). Hydrofluoroalkanes as defined above containing 4 carbon atoms are preferred. By way of example, the hydrofluoroalkane of the fixing agent used in the method according to the invention can be selected from the compounds of empirical formula $C_3H_3F_5$, $C_4H_5F_5$, $C_4H_4F_6$ and $C_5H_2F_{10}$, such as 1,1,1,3,3-pentafluoropropane (HFC-245fa), 1,1,2,2,3-pentafluoropropane (HFC-245ca), 1,1,1,3,3-pentafluorobutane (HFC-365mfc), 2-methyl-1,1,1,3,3-pentafluoropropane (HFC-365mps), 1,1,1,4,4,4-hexafluorobutane (HFC-356mff, 1,1,1,2,2,4-hexafluorobutane (HFC-356mcf) and 1,1,1,2,2,3,4,6,6,6-decafluoropentane (HFC-4310mee). 1,1,1,3,3-Pentafluorobutane is very well suited. The fixing agent can, as an alternative form, comprise a mixture of $C_3$–$C_6$ hydrofluorocarbons as defined above.

The fixing agent preferably also contains a cosolvent. Cosolvent is understood to denote an organic compound, or a mixture of a number of organic compounds, which is miscible with the $C_3$–$C_6$ hydrofluorocarbon in proportions by weight of 1:100 to 1:1.

Cosolvents which can be used in the fixing agents employed in the method according to the invention comprise $C_1$–$C_3$ alcohols (for example methanol, ethanol, propanol and isopropanol); $C_3$–$C_6$ ketones (for example acetone, methyl ethyl ketone, methyl butyl ketone, methyl isobutyl ketone and diethyl ketone); $C_2$–$C_8$ esters, formed from a carboxylic acid, such as formic acid, acetic acid, propionic acid or butyric acid, and from an alcohol, such as methanol, ethanol or propanol; and $C_1$–$C_3$ chlorinated hydrocarbons (for example dichloromethane, trans-1,2-dichloroethylene and cis-1,2-dichloroethylene).

The ketones and the esters are preferred cosolvents. The esters are the most preferred cosolvents. Among the ketones, acetone is particularly preferred. Among the esters, ethyl acetate, methyl acetate, ethyl formate and methyl formate are preferred. Ethyl acetate is very particularly preferred.

The content of $C_3$–$C_6$ hydrofluorocarbon in the fixing agent is advantageously at least equal to 50%, preferably at least equal to 60%, of the total weight of the fixing agent composition. The fixing agent can consist solely of $C_3$–$C_6$ hydrofluorocarbon. The $C_3$–$C_6$ hydrofluorocarbon content preferably does not exceed 98%, in a particularly preferred way 96% and in a very particularly preferred way 90% of the total weight of the fixing agent composition.

The cosolvent content in the fixing agent employed in the method according to the invention is advantageously at least equal to 2%, preferably at least equal to 4% and in a particularly preferred way at least equal to 10% of the total weight of the fixing agent composition. The cosolvent content does not generally exceed 40%, preferably 30% and in a particularly preferred way 20% of the total weight of the fixing agent composition.

The fixing agent employed in the method according to the invention can contain, in addition to the hydrofluorocarbon and the cosolvent, additives which make it possible to improve the performance of the fixing method, in particular stabilizers, such as nitroalkanes (for example nitromethane or nitroethane), and epoxides (for example propylene oxide or butylene oxide).

In the method according to the invention, the recording substrate, on which the toner is deposited, can be brought into contact with the gaseous chemical fixing agent in any device conveying the recording substrate, containing the toner to be fixed, in a chamber containing vapours of the fixing agent. Such devices are described, for example, in U.S. Pat. No. 4,311,723 and in Patent Application EP-A-605,128.

Conventionally, the recording substrate containing the image formed by the toner passes through a fixing chamber, the atmosphere of which is saturated with vapours of the fixing agent, at a temperature of 50° to 100° C. The fixing agent employed causes very rapid fixing of the toner to the recording substrate, which makes possible a high printing or copying rate. The recording substrate containing the toner to be fixed is typically brought into contact with the fixing agent for a period of 0.5 to 3 seconds.

The toners which can be fixed by the method according to the invention are composed of freely flowing finely divided particles based on thermoplastic resins which are coloured or pigmented, for example by carbon black, as described in particular in Kirk-Othmer, Encyclopedia of Chemical Technology, 4th Ed., Vol. 9, pages 270–271, in the chapter relating to electrophotography. The method according to the invention applies in particular to the fixing of powdered toners composed essentially of a polymeric matrix, such as, for example, a matrix based on polystyrene or on polyester, and of a pigment. The method according to the invention in which the fixing agent contains a cosolvent is particularly well suited to the fixing of toners containing a polyester-based polymeric matrix.

The method according to the invention makes it possible to fix a toner to numerous recording substrates, in particular to paper, to transparent sheets made of synthetic polymeric material and to natural or synthetic fabrics. The fixing agent employed in the method according to the invention generally does not detrimentally affect the recording substrates commonly used in printing or copying methods employing powdered toners.

The invention also relates to the compositions containing a $C_3$–$C_6$ hydrofluorocarbon and a $C_2$–$C_8$ ester corresponding to the fixing agents preferentially used in the fixing method according to the invention.

The following non-limiting examples are given by way of illustration.

EXAMPLE 1

3 ml of a fixing agent consisting of 80% by weight of 1,1,1,3,3-pentafluorobutane (HFC-365mfc) and of 20% by weight of ethyl acetate were placed in a round-bottomed flask with a capacity of 11 surmounted by a condenser, and then the round-bottomed flask was immersed in a thermostatically-controlled bath maintained at 95° C., so as to completely vaporize the fixing agent in the round-bottomed flask. A narrow paper strip was then introduced into the round-bottomed flask for 2 seconds, toner containing a polyester-based polymeric matrix (A2.5-S263 12-F497 type from Siemens-Nixdorf) having been deposited on this narrow paper strip beforehand. After this treatment, the toner proved to be firmly fixed to the paper.

EXAMPLES 2–8

Example 1 was repeated, the fixing agent being replaced by others. The nature of the fixing agents used and the degree of fixing obtained are reported in Table I below.

TABLE I

| Example | Fixing agent (weight %) | Degree of fixing* |
|---|---|---|
| 2 | HFC-365 mfc/acetone (80/20) | +++ |
| 3 | HFC-365 mfc/ethanol (80/20) | ++ |
| 4 | HFC-365 mfc/trans-1,2-dichloroethylene (70/30) | + |
| 5 | HFC-365 mfc/ethyl acetate (90/10) | +++ |
| 6 | HFC-365 mfc/methyl formate (80/20) | +++ |
| 7 | HFC-365 mfc/ethyl formate (80/20) | +++ |
| 8 | HFC-365 mfc/methyl acetate (80/20) | +++ |

*: +++ = excellent; ++ = very good; + = good

EXAMPLES 9–11

Attempts were made to find a closed-cup flash point (Pensky-Martens), according to ASTM Standard D93–90, for the fixing agents considered in Table II. Although cosolvents, such as acetone or ethyl acetate, are highly flammable, none of the fixing agents tested has a flash point. HFC-365mfc thus has a very marked inerting effect on the flammability of these cosolvents.

TABLE II

| Example | Fixing agent (weight %) | |
|---|---|---|
| 9 | HFC-365 mfc/ethyl acetate (80/20) | no flash point between −38 and 35° C. |
| 10 | HFC-365 mfc/acetone (80/20) | no flash point between −38 and 35° C. |
| 11 | HFC-365 mfc/trans-1,2-dichloroethylene (70/30) | no flash point between −30 and 40° C. |

We claim:

1. Method for fixing a toner to a recording substrate in a document printer or copier by bringing the recording substrate, on which the toner is deposited, into contact with a chemical fixing agent in the gaseous state, characterized in that the fixing agent contains a $C_3$–$C_6$ hydrofluorocarbon.

2. Method according to claim 1, in which the hydrofluorocarbon is a hydrofluoroalkane of general formula $C_aH_bF_c$ in which a is an integer from 3 to 5, b is an integer from 1 to (a+2) and c is an integer from a to (2a+1).

3. Method according to claim 2, in which the fixing agent contains 1,1,1,3,3-pentafluorobutane.

4. Method according to claim 1, in which the fixing agent contains a cosolvent.

5. Method according to claim 4, in which the cosolvent is a compound selected from the group consisting of $C_1$–$C_3$ alcohols, $C_3$–$C_6$ ketones, $C_2$–$C_8$ esters and $C_1$–$C_3$ chlorinated hydrocarbons.

6. Method according to claim 5, in which the cosolvent is a compound selected from the group consisting of acetone, ethyl acetate, methyl acetate, ethyl formate and methyl formate.

7. Method according to claim 6, in which the cosolvent is ethyl acetate.

8. Method according to claim 4, in which the fixing agent contains from 98 to 60% by weight of the $C_3$–$C_6$ hydrofluorocarbon and from 2 to 40% by weight of the cosolvent.

9. Method according to claim 4, in which the toner contains a polyester-based polymeric matrix.

* * * * *